United States Patent [19]

Tse

[11] 4,326,577

[45] Apr. 27, 1982

[54] VERTICALLY POSITIONING WINDOW SHADING SYSTEM

[76] Inventor: Brian H. Tse, 1486 17th Ave., San Francisco, Calif. 94122

[21] Appl. No.: 140,694

[22] Filed: Apr. 16, 1980

[51] Int. Cl.[3] ..... A47H 1/00

[52] U.S. Cl. ..... 160/259; 160/279

[58] Field of Search ..... 160/258, 259, 260, 246, 160/242, 243, 277, 280, 278, 279, 293 R, 237, 238, 23 R

[56] References Cited

U.S. PATENT DOCUMENTS

| | | | |
|---|---|---|---|
| 394,737 | 12/1888 | Thiel | 160/259 |
| 612,606 | 10/1898 | Forsyth | 160/279 |
| 785,806 | 3/1905 | Hopkins | 160/279 |
| 938,207 | 10/1909 | Brown | 160/259 |
| 1,112,726 | 10/1914 | Sherwin | 160/259 |
| 1,303,678 | 5/1919 | Joseph | 160/265 |
| 2,300,024 | 10/1942 | Terrell | 160/238 |
| 4,202,395 | 5/1980 | Heck et al. | 160/279 |

*Primary Examiner*—C. J. Husar
*Assistant Examiner*—Cherney S. Lieberman
*Attorney, Agent, or Firm*—Alfons Puishes

[57] ABSTRACT

A window screen arrangement comprises a novel roller combination for winding and unwinding the screen or shade element and at the same time providing for positioning of the entire screen assembly in any desired position vertically on a window to provide partial screening in any part of the window while at the same time permitting additional screening provided by the operation of the screen upon a roller. The method of supporting the screen in the window opening comprises a novel arrangement of cords for support and positioning which permit the foregoing without the use of pulleys, springs, counter-weights, hooks, clamps, or other positioning devices to hold the screen assembly in any given vertical location while permitting its roller features to function.

3 Claims, 5 Drawing Figures

VERTICALLY POSITIONING WINDOW SHADING SYSTEM

BACKGROUND OF THE INVENTION

The basic idea of positioning a roller type of window screen vertically in a window frame to change its effective area of screening is old in the art. Various devices have been patented and those known to the applicant at this time are summarized briefly below.

Thiel U.S. Pat. No. 394,737 takes an ordinary roll up type of window shade and instead of mounting it at the top of the window opening, provides for its riding on guide rods at the sides of the window with a pulley and rope arrangement to raise and lower the screen roller to any desired position.

Hewas, et al U.S. Pat. No. 707,413 accomplishes the same as Thiel without the use of side rails and employs double rope and pulley arrangements with cross ropes and frames holding the screen roller and permitting its raising and lowering by means of suitable rope and fastener arrangement.

Brown U.S. Pat. No. 938,207 teaches the use of angle iron brackets at the sides of the window providing rails from which "L" shaped plates are permitted to ride, said plates holding the roller in position, which may be altered by the use of suitable rope and pulley arrangement mounted on the window frame and attached to the slide plates holding the roller.

Britting U.S. Pat. No. 1,129,162 also employs side rails on the window with a horizontal guide and ball bearing pulleys for the guide to ride upon the location being maintained by suitable rope attachments to the guides.

South U.S. Pat. No. 1,250,043 utilizes a horizontal channel to hold the roller and a rope and pulley arrangement with fasteners to position the roller and hence the screen vertically with respect to the window opening.

Joseph U.S. Pat. No. 1,303,678 teaches the use of horizontal metal slats to hold the screen roller which are positioned vertically in the window screen by means of chain and sprocket combinations, provision being made to hold the chain in a given position and consequently provide for changing the location of the roller.

Reeder, U.S. Pat. No. 3,878,878 utilizes threaded rods and nuts positioned vertically on opposite sides of the window frame which may be rotated, thus causing the travel of the nuts which are made a part of the roller frame supports and thus provide for a change in vertical position on the screen.

Thus it is seen that all the prior art relies on combinations of pulleys, or chains, or screws with their attendant followers which attach to the rotating roller forming an upper part of the screen which is usually of a conventional type to locate this upper roller upon which the screen is rolled up in different positions to effect partial screening of the window in any portion desired. The rolling and unrolling of the screen is accomplished in a conventional manner in all of the prior art, that is by spring action of the roller.

SUMMARY OF THE INVENTION

I have invented a screen and roller combination which departs from the traditional screen arrangement in which the rotating roller is located above and the screen is unrolled therefrom as my rolling screen is located below the area of the screen which is positioned on its opposite end upon a second roller. Both rollers are supported in position by a novel cord arrangement which permits the entire screen to be raised and lowered by means of the upper roller and the screen opening altered by rotation of the lower roller, the entire structure obviating the necessity of any positioning pulleys, chains, ropes or other positioning devices. This I accomplish by the novel construction of my rollers on which the screen is positioned and the method of supporting these rollers in a window opening by means of the support cords which are so threaded through the rollers as to permit such maintenance of the screen in any desired relative position in the window while at the same time permitting the rolling and unrolling of the screen to provide the extent of screening desired. The whole assembly is maintained in equilibrium by the tension of a cord support arrangement relative to the rollers and the window frame. The novelty and advantages of my construction will be evident from the description which follows.

DESCRIPTION OF A PREFERRED EMBODIMENT

Figure 1:
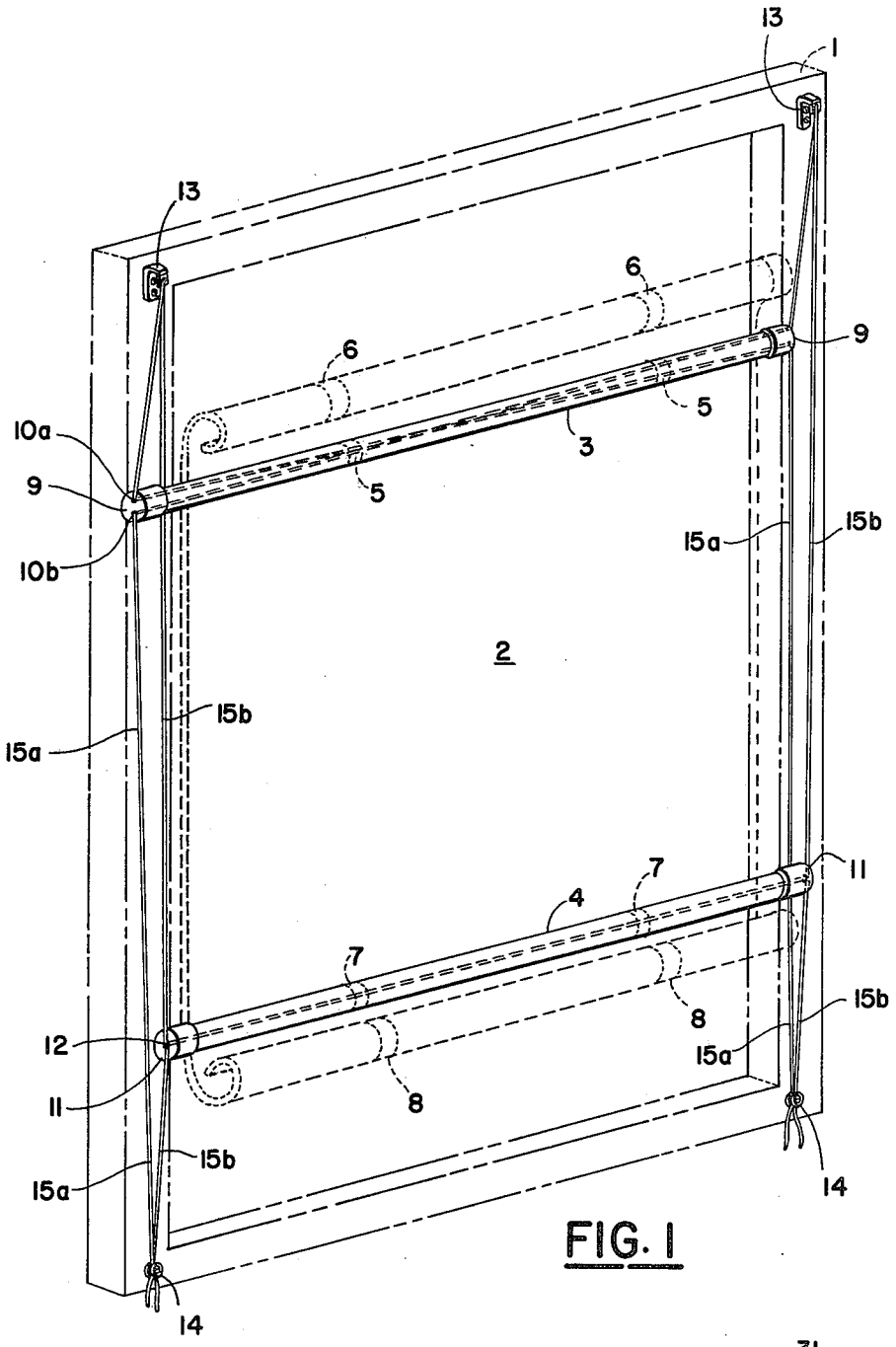
FIG. 1 is an isometric view of a window opening showing my rollers, screen detached and cord support in operating arrangement in position.

Referring now to the figures and especially first to FIG. 1, there is seen a typical window frame 1 with the screen 2 of my invention. I utilize an upper non-rotating roller 3 in combination with a rotating roller 4 for my system. Fastening means 5 positioned upon roller 3 engages with companion fastening means 6 positioned on the upper end of screen 2. For this means I may use "Velcro" the trademark of a fastener manufactured by the Velcro Corporation. In like manner I use this type of fastener 7 positioned on roller 4 which engages with fastener 8 on the lower end of screen 2. Use of these fasteners permits ready removal of screen 2 from the rollers for cleaning purposes.

At the outer ends of roller 3 are positioned knobs 9 which form a part thereof. In each of knobs 9 there is drilled an upper hole **10*a* and a lower hole 10*b*** the function of which is set forth below.

On lower roller 4 I position knobs 11 at each end of which are drilled concentric holes 12 whose function is also set forth below.

Figure 2:
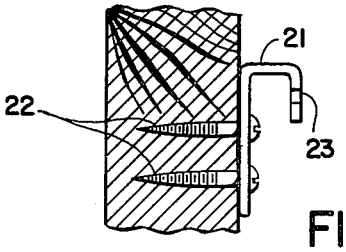
FIG. 2 is a bracket positioned on the window frame to hold my cord arrangement.
Figure 3:
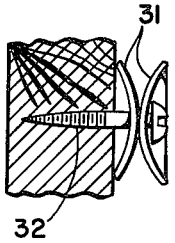
FIG. 3 is a fastening means positioned at the lower end of the window frame to hold the ends of the cords used in my construction in position and tension.

Hooks 13 are positioned at the upper end of window frame 1 and are shown in greater detail on FIG. 2. Anchors 14 are positioned on the lower end of frame 1 opposite hooks 13.

For my support and operating means I employ cords generally designated and specifically shown at **15*a* and 15*b*. These I suspend from the hooks 13 comprising a bracket 21, anchor screws 22 and a hole 23 and thread through my rollers in the following manner. Thus, starting and having one end of my cord fastened to hooks 13 through hole 23 I first pass cord 15***a* down and through the top hole 10*a* and knob 9 through the hollow interior of roller 3 and out through the opposite end through the lower hole 10*b* and down to anchor 14. I do this at both the right and left end of the window frame from hooks 13 and the cord 15*a* is shown passing through the hollow roller 3 from either end crossing internally from the upper hole 10*a* and into the lower hole 10*b* at opposite end and down vertically to the anchor 14.

I next fasten cord 15*b* to the hooks 13 at each end through hole 23 and pass this vertically from each of hooks 13 down to concentric holes 12 in each of knobs 11, pass these cords horizontally through the hollow interior of roller 4 and out on the opposite ends and downwards, also fastening to anchor 14. The cords 15*a* and 15*b* are then stretched to provide adequate tension to hold roller 3 and 4 in their respective positions parallel to each other and holding screen 2 in position with respect to each other. Anchor 14 comprises clamps 31 and retaining screw 32.

OPERATION

To place my system in operation and to subsequently operate it the following steps are to be followed.

First of all, non-rotating upper roller 3 is placed in the highest possible position in window frame 1. This is accomplished by merely physically moving roller 3 upwards, the cords 15*a* sliding through the hollow interior of roller 3 while maintaining tension between hooks 13 and anchors 14. Screen 2 is then attached to non-rotating roller 3 by means of fastening means 5 and 6 described above. The screen 2 is then stretched down its full length and its lower edge engaged upon rotating roller 4 by means of fastening means 7 and 8. To change the effective screening length of screen 2, bottom rotating roller 4 is then merely rotated by hand, causing the screen to wind up upon its perimeter. When shortening, the roller 4 will move upwards and cords 15*b* being concentric will permit this movement upwards along the length of the cords while maintaining tension between hooks 13 and anchors 14. Any desired amount of screening area may be obtained depending upon how much of the screen is rolled up on roller 4.

To position the screening area vertically in the window opening in order to locate the effective screening area in a desired elevation, roller 3 is grasped and is physically moved upwards or downwards. In this case, the cords 15*a* passing through holes 10*a* and 10*b* and the hollow interior of roller 3, slide through the roller and maintain its position because of the tension and friction of the cords brought about by their passage through the hollow interior of roller 3 and the tension maintained between hooks 13 and anchor 14. In this manner any desired amount of area of window may be screened and the location of the screened area positioned vertically at any desirable point, the rollers 3 and 4 being maintained in position by the action of the cords 15*a* and 15*b*.

Figure 4:
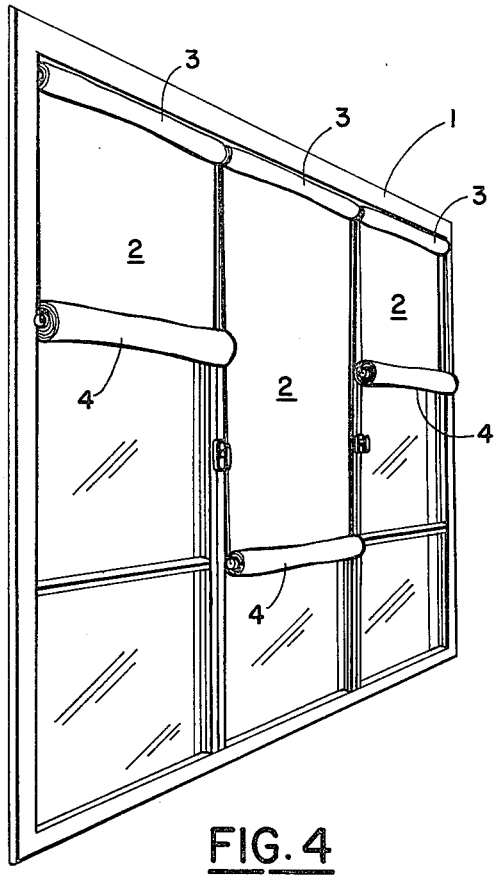
FIG. 4 shows a typical three pane window with three of my screens in different positions showing the application of my invention.
Figure 5:
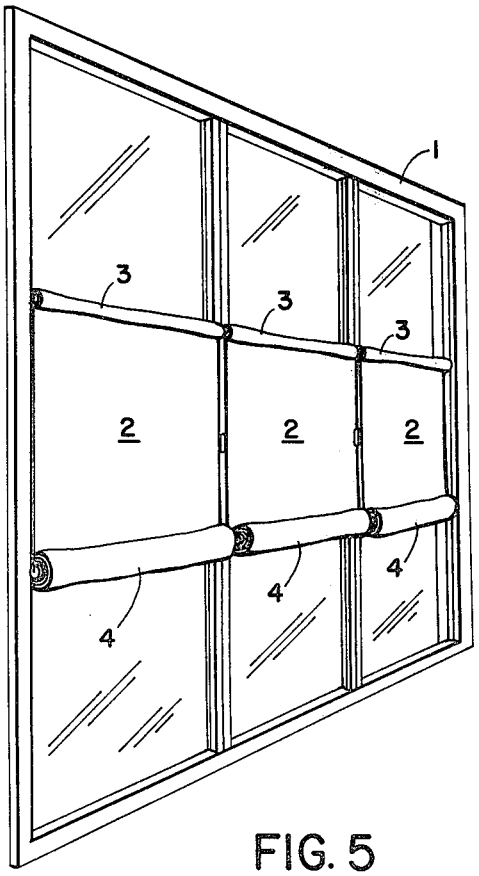
FIG. 5 is another three pane window arrangement showing another series of positions of my rollers and screens which I may obtain by the use of my invention.

The result of the foregoing may be seen by the appearance of the screening system on FIG. 4 and FIG. 5. Thus, in FIG. 4 the central pane is shown as screened two-thirds of the way whereas the two end panes are shown on the screen only one-third permitting vision to be greater through these panes than through the center where this is desirable.

In the position shown on FIG. 5 the central portion of the window is shown screened out, permitting outward view above and below the screens. This is particularly effective when the sun is in a certain position and it is desired to screen it off and yet maintain vision to the outside. If a change in screened area is desired, the percentage of the window pane screened may be altered by merely rotating roller 4 against the tension of the cords as described above. If it is desired to change the location of the screened area, while leaving the percentage screened off the same, the position of the screen is then changed by merely pushing non-rotating roller 3 upwards or downwards against the action of the corresponding cords as described above and the screen will be retained in any desired relative position.

The simplicity of operation and construction of my system is now evident as is its novelty and superiority over the prior art devices which require elaborate systems of pulleys and ropes and other devices as set forth above and which I eliminate.

I claim:

1. A vertically positioning window shading system comprising:

a first upper hollow non-rotating horizontal roller;

a second lower hollow rotating roller parallel to said first roller;

a vertical screen having one of its parallel horizontal edges fixedly positioned upon said first roller and its opposite edge fixedly positioned on said second roller;

a first pair of cord means having one of their ends fixedly positioned on opposite sides of the upper edge of a window frame;

said first pair of cord means being disposed to suspend said first roller through its hollow center while permitting a vertical movement of translation of said first roller along said cords;

a second pair of cord members having one of their ends fixedly positioned on the opposite sides of the upper edge of said window frame;

said second cord means being disposed to suspend said second roller through its hollow center while permitting a combined movement of rotation and translation of said second roller;

said first roller being equipped with caps at each end, each of said caps having a pair of holes positioned one above the other drilled through them;

said second roller being equipped with caps at each end, each of said caps having a hole drilled through it concentric to said roller;

each of the cords of said first pair of cord means passing in turn through the upper of said holes in one end of said first roller, thence through the interior of said first roller thence through the lower of said holes in the opposite end of said roller thence vertically to a fixed position at the bottom of said window;

each of the cords of said second pair of cord means passing in turn through said concentric hole in one end of said second roller thence through the interior of said second roller, thence through the hole in the opposite end of said roller, thence vertically to a fixed position at the bottom of said window;

said cord means being maintained under tension at all times.

2. The system of claim 1 in which the effective area of said screen may be modified by manually rotating said second roller about said cord means and causing said screen to roll up on said roller.

3. The system of claim 1 in which the vertical position of said screen upon said window may be modified by manually raising or lowering said non-rotating roller along said cord means.

* * * * *